United States Patent [19]

Danley et al.

[11] Patent Number: 5,036,944

[45] Date of Patent: Aug. 6, 1991

[54] METHOD AND APPARATUS FOR ACOUSTIC LEVITATION

[75] Inventors: Thomas J. Danley, Highland Park; Dennis R. Merkley, Wauconda; Charles A. Rey, Naperville, all of Ill.

[73] Assignee: Intersonics Incorporated, Northbrook, Ill.

[21] Appl. No.: 843,022

[22] Filed: Mar. 24, 1986

[51] Int. Cl.[5] ..... G10K 11/00

[52] U.S. Cl. ..... 181/0.5; 73/505

[58] Field of Search ..... 181/0.5, 139, 140, 142; 73/505; 23/313 R; 55/15, 277; 432/11, 121, 124; 264/23; 367/191

[56] References Cited

U.S. PATENT DOCUMENTS

| | | | |
|---|---|---|---|
| 3,882,732 | 5/1975 | Fletcher et al. | 181/0.5 X |
| 4,052,181 | 10/1977 | Fletcher et al. | 73/505 X |
| 4,218,921 | 8/1980 | Oran et al. | 73/505 |
| 4,284,403 | 8/1981 | Rey | 181/0.5 X |
| 4,393,706 | 7/1983 | Barmatz | 73/505 |
| 4,393,708 | 7/1983 | Barmatz et al. | 73/505 |
| 4,420,977 | 12/1983 | Elleman et al. | 73/505 |
| 4,447,251 | 5/1984 | Dunn et al. | 73/505 X |
| 4,463,606 | 8/1984 | Barmatz | 73/505 |
| 4,475,921 | 10/1984 | Barmatz | 23/313 R |
| 4,688,199 | 8/1987 | Lock | 367/137 |
| 4,736,815 | 4/1988 | Barmatz et al. | 181/0.5 |

*Primary Examiner*—Brian S. Steinberger

*Attorney, Agent, or Firm*—Juettner Pyle Lloyd & Verbeck

[57] ABSTRACT

An acoustic levitator includes a pair of opposed sound sources which have interfering sound waves producing acoustic energy wells in which an object may be levitated. The phase of one sound source may be changed relative to the other in order to move the object along an axis between the sound sources.

26 Claims, 2 Drawing Sheets

FIG. 1
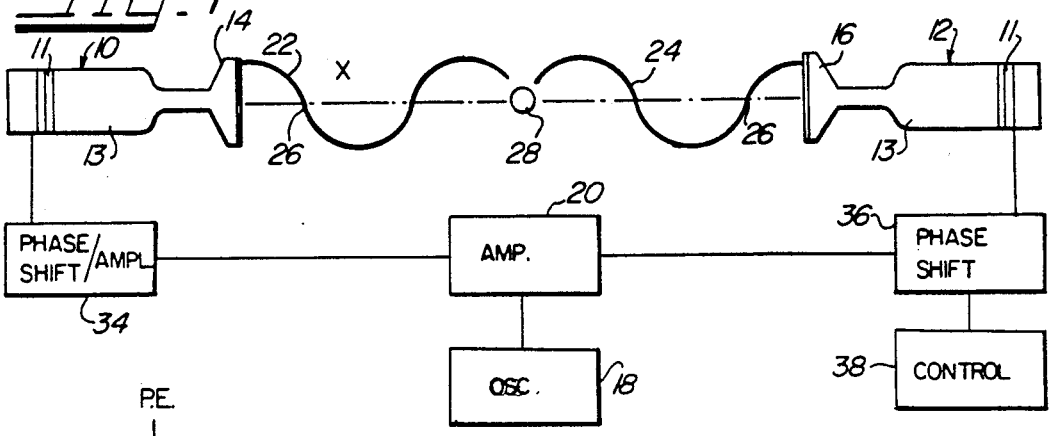
FIG. 2a
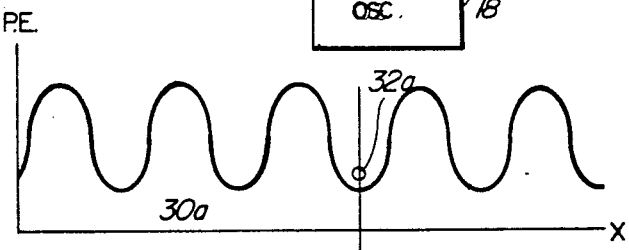
FIG. 2b
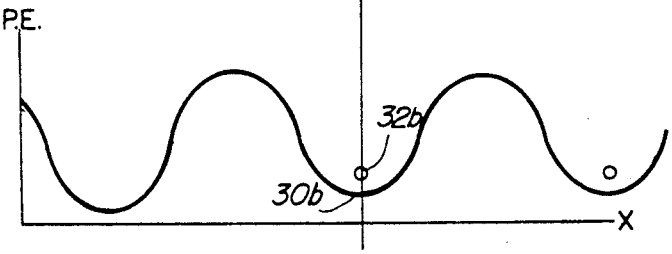
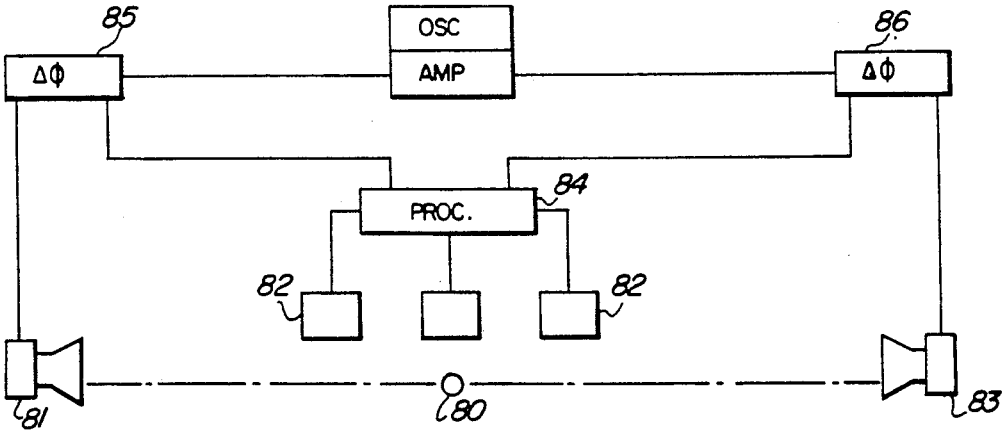
FIG. 6

METHOD AND APPARATUS FOR ACOUSTIC LEVITATION

BACKGROUND OF THE INVENTION

This invention relates to acoustic levitation wherein the force of sound waves are used to suspend, position or manipulate an object such as a solid or liquid.

As described in U.S. Pat. No. 4,284,403, the potential practical applications for acoustic levitation are numerous and varied. Many potential applications exist whenever there is a need to hold, move, store, position, or process an object without contact with any surface, particularly if such contact would damage or contaminate the object or otherwise interfere with some desired property or state of the object. For example, an object which is melted by conventional means at high temperatures will be contaminated by the container, and acoustic levitation offers the possibility of containerless melting as well as other containerless or non-contact processing involving, for example, chemical reaction, alteration of physical shape, agitating, coating, combining, conveying, and the like.

Acoustic levitation also lends itself to manufacturing processes in outer space by preventing drift of materials being processed in zero gravity. Experiments are being conducted to enable processing of acoustically positioned objects in future space stations.

Prior art levitation devices have developed along two separate lines. In one type of device, one or more sound sources are connected to a chamber in which a reflective wall opposes the sound source. The wall is positioned at n(x/2) from the sound source, wherein x is the wavelength of the sound, and n is a whole number. This causes a standing wave pattern to be produced in which objects may be positioned in the pressure nodes of the waves. Acoustic levitation devices which use resonant cavities are shown, for example, in the following U.S. Pat. Nos. 3,882,732; 4,052,181; 4,420,977; 4,393,706; 4,393,708; 4,463,606; and 4,475,921.

There are serious drawbacks in the use of a resonant cavity as described above. The cavity must be contained within an enclosure in which the geometry is critical. In addition, the cavity must be carefully tuned, and variations of temperature cause loss of essential resonance unlesss the cavity is constantly retuned.

Another type of acoustic levitation device is referred to as a single axis levitator. An improved form of this class of device is shown in the aforesaid U.S. Pat. No. 4,284,403. In such a device, sound waves are reflected from a small reflector to create an energy well, based on localized interference, which is independent of resonance or standing waves. Such a device is not sensitive to temperature changes and does not require an enclosure having reflective surfaces. As a result, levitated objects can be easily moved from one position to another in any direction and without regard to the confines of an enclosure or temperature variations. The only potential drawback with such device is that the energy well that supports the levitated object is located near the small reflector.

SUMMARY OF THE INVENTION

It would be desirable to provide an acoustic levitation device which is not dependent upon factors such as temperature variations, tuned chambers, or positioning of reflectors, while allowing complete freedom to move or otherwise manipulate the levitated object, objectives which have never heretofore been successfully attained.

In accordance with the present invention, a passive reflector is not used. Rather, opposed sound sources are positioned along a common axis and operate at the same frequency. The radiating sound from the sources intact or interfere to provide a number of pressure modes spaced at half wavelengths along the common axis, said nodes being areas of minimal pressure in which objects may be stably levitated. Establishment of the nodes is independent of the resonance of a tuned cavity. Moreover, compared to present sound sources employing a single sound source and reflector, the two sound sources provide a significantly increased sound field strength.

The opposed sound sources may be used to position one or several objects along the common axis of sound propagation in a fixed position. In addition, the phase of the sound from one source may be varied relative to the other to produce an axial displacement or change of the position of the pressure nodes along the axis and hence an axial displacement of the levitated object in either axial direction. Thus, the levitated object can be conveyed along a line by making a continuous change in relative phase, or the object can be moved in one direction and then in the reverse direction, and at fixed and variable rates of speed. Rapid, small reversing changes in relative phase can be used, for example, to vibrate the object. Control of the phase can be easily arranged to compensate for temperature changes which affect the wavelength. The phase control can be made responsive to a position detection means to keep an object into a constant position.

More than one pair of sound sources may be positioned along different axes which intersect each other at various points, in order to provide a transfer of the levitated object from one axial system to another, or to enhance the strength of an energy well at a given location. The intensity or amplitude of the sources may also be varied to produce uneven pressures on the levitated objects, such that the object may be shaped or rotated.

The apparatus and method of the present invention allows for considerable freedom in the ability to process or convey a levitated object through various stages, such as heating, cooling and other processing. Levitated objects may also be combined, sorted, or moved to various locations in three dimensions.

THE DRAWINGS

FIG. 1 is a simplified schematic view of the device of the present invention wherein a pair of opposed sound sources are arranged along a common axis to levitate an object.

FIG. 2*a* is a graph showing the energy wells established along the axis x at a given wavelength.

FIG. 2*b* is a graph showing the energy wells established along the axis x at a wavelength which is longer than the wavelength shown in FIG. 2*b*.

FIG. 6 illustrates the use of monitoring or feedback sensors in conjunction with an axial levitation.

DESCRIPTION OF THE PREFERRED EMBODIMENTS

Figure 3:
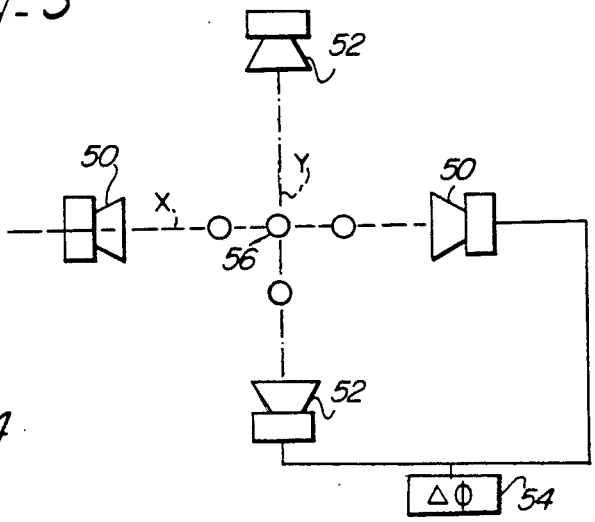
FIG. 3 illustrates pairs of axial levitators intersecting at a point.

FIG. 1 illustrates a pair of opposed sound sources 10 and 12 having respective sound radiating surfaces 14 and 16 which generate sound toward each other substantially along a common axis x. The sound sources may be conventional in nature but preferably are capable of producing sound of high intensity, i.e., above 120dB and preferably above 150dB. The sound sources or transducers 10 and 12 may be of the solid piston type containing electro-mechanical driving means, such as piezoelectric or magnetostrictive, or a conventional voice coil.

As shown in FIG. 1, the sound radiating surfaces 14 and 16 are preferably concave or dish shaped in order to concentrate or beam a useful column of intense sound in opposite directions along the axis x. The sound sources are connected to a common oscillator 18 and one or more amplifiers 20 to produce sound at the same frequency. In the embodiment shown, each sound source includes a plurality of piezoelectric wafers 11 receiving a signal from the oscillator 18 and held in compression with a cylindrical rod or piston 13 secured to the concave dishes 14 and 16. The wafers expand and contract or vibrate at high levels of force to cause vibration of the rod 13 and dish 14 or 16.

When the sound sources 10 and 12 are driven at the same frequency, an interference wave pattern is established therebetween. Preferably, the sound sources are also driven at the same intensity to produce a uniform interference pattern. For the sake of illustration, the pattern shown in FIG. 1 is shown to include a sound wave 22 from source 10 and a sound wave of the same wavelength 24 from source 12, which, at certain points along the axis x, interfere and reinforce each other and provide nodes 26 of low acoustic pressure. The nodes 26 appear at each half wavelength of the sound being used and define energy wells in which solid or liquid objects such as 28 may be stably levitated. The nodes or energy wells 26 provide resultant forces which hold or contain the object 28 both axially and radially. If the sound being employed is sufficiently intense objects may be levitated against the force of gravity.

Unlike prior art devices which use a reflector in opposition to a sound source to produce resonance or standing waves, the acoustic levitator of the present invention operates by means of wave interference and does not require the use of a chamber. Hence, the distance between the sound sources is not critical, since no standing waves or resonance are involved. In addition, as will be explained more fully herein, the temperature of the sound transmitting gas is not critical, as with the case of resonant chambers, which quickly become detuned with changes in temperature. This feature is important because a primary use of acoustic levitation devices is to heat or melt suspended objects without contact with a foreign surface that would contaminate the object.

FIGS. 2*a* and 2*b* illustrate the independence of the present system to temperature changes. These figures are graphs illustrating the acoustic potential energy distribution along the axis of interference, i.e., the axis between the opposed sound sources. At a given temperature, as shown in FIG. 2*a*, the interference causes one or more nodes 30*a* of minimum potential energy in which an object 32*a* may be levitated. If the temperature of the sound transmitting gas is increased, the wavelengths of sound from each of the opposed sources 10 and 12 increase to the same degree, and a similar interference occurs and continues to produce the energy well 30*b* in which the object 32*b* continues to be levitated. This energy well will not change position if it is equidistant from each of the opposed sources 10 and 12.

With reference to FIG. 1, phase shift controls 34 and 36 may be connected to either one or both of the sound sources in order to change the phase of one sound source relative to the other, for example, by a control 38. The control may be adjusted to provide a positive, negative or zero change of phase of one sound source relative to another. Change of relative phase between the sound sources causes a corresponding change in the location of the energy wells 26 along the axis x. Thus, a change in phase will cause the levitated object 28 to move along the axis x in either axial direction, depending on whether a positive or negative phase change is made.

The degree of axial movement ($\Delta x$) or translation of the levitated object for a given change of phase in radians ($\Delta\phi$) at a given wavelength ($\lambda$) is defined as:

$$\Delta x = \frac{\Delta\phi}{2\pi} \cdot \frac{\lambda}{2}$$

The velocity of the levitated object during a continuous and constant rate of phase change per unit time is defined as:

$$\frac{\Delta x}{\Delta t} = \frac{\lambda}{4\pi} \cdot \frac{\Delta\phi}{\Delta t}$$

It may be seen that a relative change between the two sound sources allows movement of the levitated object toward or away from either sound source at a constant or variable speed. For example, a rapid periodic reversal or modulation of phase would cause the object to be agitated or vibrated. The phase change can be programmed in advance, for example, to move an object to a given location, stop the object, and then move the object away from the location along the common axis. Thus, the levitated object could be moved into a hot zone for melting and then into a cool zone. Since several spaced energy wells are created along the axis, a plurality of objects, such as shown in FIG. 2, may be stably levitated along the axis in a spaced relation and may be moved simultaneously by a phase shift.

Figure 5:
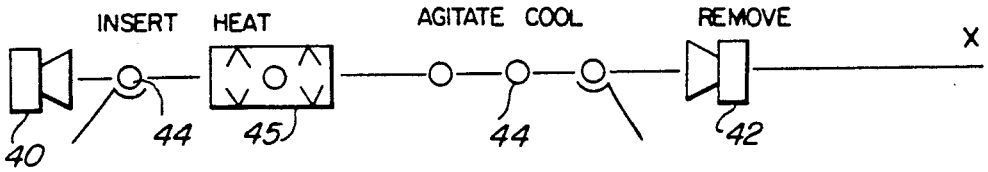
FIG. 5 is a schematic illustration of the processing of a levitated object along a production line.

A schematic version of a system for melting and cooling an object is shown in FIG. 5, which includes a pair of opposed sound transducers 40 and 42 operating along an axis x at the same frequency. Objects 44 may be inserted into an energy well on one side of an open furnace 45. The object may then, by using an appropriate phase shift, by moved into the furnace and stopped if desired. The object may then be moved to a cool zone for solidification and removal.

As shown in FIG. 3, two or more pairs of opposed sound sources 50 and 52 operating on intersecting axes x and y may be employed. At the point of intersection, the object may be transferred from one axis to another. Thus, a levitated object can be moved along one axis and then along a second, third or forth or more axes. To facilitate transfer between axes, it may be desirable to disrupt or decrease the sound between two of the opposed sources to allow transfer to the other axis at the intersections. Obviously, any number of sound sources with one or several points of intersection may be employed to move the levitated object in any direction. Also, the systems of pairs of opposed sources may be operated at different frequencies to provide independent control and to facilitate transfer from one system to another.

Whenever pairs of opposed sound sources are employed as shown in FIG. 3, it is possible to drive the opposed pairs at the same frequency or at different frequencies, with each opposed pair being connected to their own phase controls, as shown in FIG. 1. If the sources are driven at the same frequency, it is also possible to connect a separate phase control 54 between non-opposed sources. Adjustments of phases between the two axes can be employed to impart a torque on and hence spin to the levitated object 56. Regardless of whether opposed sources are driven at the same frequency, the amplitude of the sound may be modulated to cause vibration of the object.

Figure 4:
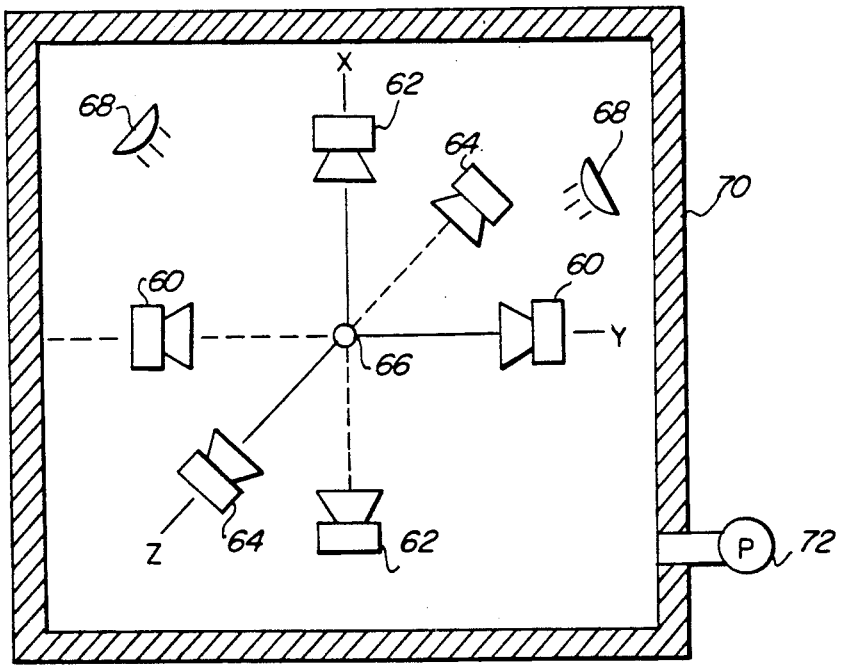
FIG. 4 illustrates three axial levitators arranged in three dimensions and intersecting at a common point.

FIG. 4 shows another version of which three pairs of opposed transducers 60, 62 and 64 operate on three separate axes x, y and z and intersect at a common point. A levitated object 66 located at the intersection can be moved along any of the axes in three dimensions. The version illustrated may also include heaters such as 68 to heat the object by radiation or by laser beams from one or a plurality of directions.

Also, as illustrated in FIG. 4, the apparatus of the present invention may be installed in a gas tight chamber 70, together with conventional means, such as a pump 72, to pressurize the chamber. An increase in pressure allows for much higher sound forces to be exerted on the levitated object for the same vibrational amplitude of the sound source. The use of intersecting axes offers several important possibilities. Two or more levitated objects may be combined at the point of intersection. If the object is pliable, its shape can be changed by increasing or decreasing the sound pressure between one pair of sound sources relative to another. A change in phase of one set of transducers relative to another may also be employed to spin or vibrate the levitated object.

FIG. 6 illustrates the use of monitoring or feedback devices in conjunction with the apparatus of the present invention. In some cases, it may be desirable to sense or otherwise determine the location of levitated objects 80, energy wells, or temperature zones, especially if the apparatus is mounted in an enclosure or cannot otherwise be observed. One or a plurality of sensors 82 may be positioned along or near the axis betwen the opposed sound sources 81 and 83. The sensors may be of various types, such as microphones, heat sensors, photo detectors, video cameras and the like.

The sensors can be connected to a monitor or information processing device, indicated at 84, which can be used to control one or a number of variables in the system. In the embodiment shown, the processor 84 is connected to the individual phase controls 85 and 86 connected to the respective sound sources 81 and 83. Thus the processor 84 can be programmed or adjusted to adjust the relative phase between the sources in response to the sound position of the levitated object along the axis between the sources.

We claim:

1. Method for acoustically levitating an object along a first axis in a sound transmitting medium comprising the steps of providing a pair of independent opposed, spaced sound sources along said first axis, operating the sound sources at substantially the same frequency such that the sound waves from the respective sources interfere without use of reflective surfaces and creation of standing waves to create at least one well of acoustic energy between the interfering sound waves, and disposing the object into said one well to acoustically levitate the object.

2. The method of claim 1 wherein the phase of the sound of one source is changed relative to the other, whereby said object is moved along said axis.

3. The method of claim 2 wherein a second pair of opposed sound sources are operated at substantially the same frequency along a second axis, said second axis intersecting with said first axis.

4. The method of claim 3 wherein an object is levitated at the intersection of said first and second axes.

5. The method of claim 3 wherein the frequencies employed along said first and second axes are different.

6. The method of claim 3 wherein the frequencies employed along said first and second axes are substantially the same.

7. the method of claim 6 wherein the phase of the sound along one axis is adjusted relative to the other axis to spin the object.

8. The method of claim 1 comprising the additional step of heating the levitated object.

9. The method of claim 1 comprising the additional step of pressurizing the sound transmitting medium.

10. The method of claim 8 comprising the additional step of pressurizing the sound transmitting medium.

11. The method of claim 1 wherein said sound sources focus sound along said axis.

12. The method of claim 2 comprising the additional step of sensing the position of said object along said axis.

13. The method of claim 1 wherein a plurality of pairs of opposed sound sources are operated along respective other axes, at least some of said other axes intersecting said first axis.

14. The method of claim 4 wherein said object is moved from one axis to another.

15. The method of claim 12 comprising the additional step of adjusting said phase in response to the sensed position.

16. Apparatus for acoustic levitation and positioning of an object comprising a sound transmitting medium, a first sound source operating at a given frequency along an axis in one direction, a second independent sound source facing the first source and operating at substantially the same frequency as the first source (along said axis in the opposite direction), and means for driving said sound sources at sufficient intensity to create interference and pressure nodes for supporting said object, (said apparatus) the creation of said interference and pressure nodes being independent of (resonance) standing waves and reflective surfaces (for levitating said object).

17. Apparatus of claim 16 further comprising means for changing the phase of the sound from one source relative to the other to move the object along said axis.

18. The apparatus of claim 16 wherein said sound sources comprise means for focusing the sound in a beam along said axis.

19. The apparatus of claim 16 further comprising means for heating said levitated object.

20. The apparatus of claim 16 further comprising means for pressurizing said sound transmitting medium.

21. The apparatus of claim 16 further comprising means for detecting the position of said object on said axis.

22. The apparatus of claim 16 further comprising a second opposed set of sound sources operating along a second axis intersecting with the axis between the first sources.

23. The apparatus of claim 16 further comprising means for modulating the amplitude of the sound from one or more of said sources.

24. The apparatus of claim 16 wherein the sound sources comprise a vibrating dish.

25. The apparatus of claim 24 wherein said dish is focused toward said axis.

26. A method of acoustic levitation comprising the steps of disposing an object to be levitated in a pressure node of interfering opposed independent sound sources, said pressure node being independent of standing waves and reflective surfaces, and moving said object along a line between the sound sources by changing the phase of the sound of one source relative to the other.

* * * * *